US006709250B1

(12) United States Patent
Xiong

(10) Patent No.: US 6,709,250 B1
(45) Date of Patent: Mar. 23, 2004

(54) GEAR AND A FLUID MACHINE WITH A PAIR OF GEARS

(76) Inventor: Wei Xiong, No. 42, Entrance 3, Building 2, Shiweixiqu, Tumen, Lianhu District, Xi'an City, Shaanxi 710077 (CN)

( * ) Notice: Subject to any disclaimer, the term of this patent is extended or adjusted under 35 U.S.C. 154(b) by 0 days.

(21) Appl. No.: 10/009,717

(22) PCT Filed: Jun. 14, 2000

(86) PCT No.: PCT/CN00/00156

§ 371 (c)(1),
(2), (4) Date: Jun. 7, 2002

(87) PCT Pub. No.: WO00/77419

PCT Pub. Date: Dec. 21, 2000

(30) Foreign Application Priority Data

Jun. 14, 1999 (CN) ..... 99115795 A
Jun. 17, 1999 (CN) ..... 99115799 A

(51) Int. Cl.[7] ..... F03C 2/00
(52) U.S. Cl. ..... 418/206.5; 418/171; 74/462
(58) Field of Search ..... 418/206.5, 170, 418/171, 166; 74/462

(56) References Cited

U.S. PATENT DOCUMENTS 31,597 A * 3/1861 Morris et al. ..... 418/206.5
184,284 A * 11/1876 Hardy ..... 418/170
3,214,907 A * 11/1965 Martin ..... 418/9
3,574,491 A 4/1971 Martin
3,945,777 A * 3/1976 Labus ..... 418/206.6
5,682,793 A 11/1997 Liao

FOREIGN PATENT DOCUMENTS

| | | |
|---|---|---|
| CN | 1181473 A | 5/1998 |
| DE | 2330992 A1 | 1/1975 |
| DE | 3324485 A1 | 1/1985 |
| WO | WO 91/02888 | 3/1991 |
| WO | WO 99/46507 | 9/1999 |

* cited by examiner

*Primary Examiner*—Thomas Denion
*Assistant Examiner*—Theresa Trieu
(74) *Attorney, Agent, or Firm*—Seed IP Law Group PLLC

(57) ABSTRACT

A kind of gear is provided with shorter teeth, transition teeth and at least one longer tooth. The cross-section of the longer tooth is of a hawk beak shape, and the profile of the longer tooth is smoothly connected in series by a convex section, a tip section, a concave section, and a leading section The two sides of the longer tooth are each provided with a transition tooth which neighbors a shorter tooth on the opposite side of the longer tooth. The pair of engaging gears according to this invention have advantages of reducing the fluid leakage, canceling the inertia of the rotors, and minimizing the vibration and noise. This invention also discloses a fluid machine for conveying, compressing or expanding liquid or gaseous fluids, which includes a casing comprising a housing, an upper end cover and a lower end cover. At least one pair of engaging gears which includes one driving rotor according to this invention and one driven rotor according to this invention is accommodated in the housing. As a result, the leakage between the rotors can be reduced, therefore the compression ratio can be improved. In addition, over compression and under compression can be avoided in operation.

36 Claims, 14 Drawing Sheets

GEAR AND A FLUID MACHINE WITH A PAIR OF GEARS

FIELD OF THE INVENTION

The present invention relates to a gear, more particularly, to the gear which has at least one longer tooth, shorter teeth and transition teeth.

In addition, the present invention relates to a fluid machine more particularly, to the fluid machine for conveying, compressing or expanding liquid or gaseous fluids, which has at least one gear pair according to the present invention.

PRIOR ART

In the prior arts in addition to be widely used as driving force transmission, the gear can also be used in many other fields. For example, a pair of gear-shaped rotors can be used as a gear pump to transport liquid fluids. However, the effective area used for fluid transferring by the rotors of the gear pump is relatively small, so the pumping efficiency is kept low. U.S. Pat. No. 3,574,491 discloses a gear-type rotary machine for transporting liquid fluid and compressing or expanding gaseous fluids, which consists of a housing and two engaging gear-shaped rotors being accommodated in the housing. Each gear includes two sets of shorter teeth alternating with one or more longer teeth. Because the two engaging gear-shaped rotors are provided with longer teeth, the effective area used for fluid transferring by the rotors of the gear pump is greatly increased. Unfortunately, when the longer teeth of the two rotors go to be near the inflection point of the "8"-shaped housing, because the profile of the longer tooth is not perfectly designed, the seal effect cannot be kept between the two longer teeth, resulting in a great amount of liquid backflow, thus the efficiency of the fluid transmission is caused at a low level, with nearly no function of compressing or expanding gas. In fact, although the two rotors keep engaging with each other, they are out of actual metallic contact with each other; additional torque transmitting gears have to be mounted outside so as to drive the shaft of the rotor, so the size of the rotor machine has to be increased.

U.S. Pat. No. 5,682,793 discloses an engaging rotor. When it is used for compressing gas, the gas in the tooth groove 3 of the rotor 1 cannot be compressed, only being moved from the inlet to the outlet. When the groove communicates with the compression chamber or the outlet, the gas is compressed at a constant volume, resulting in the power consumption increased and noise generated. When used for compressing gas, it becomes a rotor compressor with partial built-in compressing process. If every rotors are formed with a longer tooth and a longer tooth groove, when the longer teeth go to be near the inflection point of the "8"-shaped housing, the perfect seal effect cannot be realized, so some liquid will backflow and leak to the outside, thus the engaging rotor of this patent is inappropriate to be used in a compressor.

On the other hand, in the rotary compressors according to the prior art, the rotor compressors, the sliding-plate compressor, and the rotary vane compressor are all provided with the sliding-plates, the springs, the valves or the like which are easy to be damaged. The screw-rod compressor or the scroll compressor is simple in structure, but their curve surfaces are complex in shape, so it is difficult to be manufactured and checked. More particularly, in condition that those compressors are miniaturized, above-mentioned drawbacks are even worse. For the single tooth rotor compressor, the two rotors are out of actual metallic contact with each other, a clearance is kept between the corresponding engaging points of the two rotors. In such kind of compressor, a great of leakage between the two rotors can not be prevented, and it is difficult to make the compression ratio big enough. In fact, the single-stage compressor can only be used as an air blower. Because the rotors cannot transmit force to each other for their profiles, the angular position and the rotation of one rotor relative to another are controlled by a separate gear which can be synchronously rotated with said one rotor. The synchronous gear and its assembly make the compressor complex in structure and big in volume.

OBJECT OF THE INVENTION

An object of the present invention is to provide a gear as a component of fluid compressing or expanding machine so as to transport fluid more efficiently.

Another object of the present invention is to provide a gear whose inertia force when used as a rotor can be cancelled out completely, although the teeth of which have different sizes with respect to each other.

A further object of the present invention is to provide a gear pair for reducing the leakage between the two engaging gears as rotors.

An additional object of the present invention is to provide a compressor or expansion machine, which has a complete built-in compression process, so its compression ratio can be obviously enhanced, so that the single-stage compressor can also be used as the compressor for generating pressured gas and the compressor for refrigerator, without over compression and under compression.

Another object of the present invention is to provide a fluid machine which have a perfect sealing effect.

TECHNICAL SOLUTIONS

A gear pair according to the present invention are formed as at least two gear-shaped rotors that engage with each other, so that the driving force can be transmitted. The driving gear and the driven gear are provided with shorter teeth, transition teeth and at least one longer tooth on their pitch circles respectively. The cross-section of the longer tooth is of a hawk beak shape, and the profile of the longer tooth is smoothly connected one after another by a convex section of the longer tooth, a tip section of the longer tooth, a concave section of the longer tooth and a leading section of the longer tooth. A transition tooth is provided on each of the two sides of the longer tooth. Each transition tooth is provided in neighborhood relationship with the longer tooth on one side thereof and a shorter tooth on the opposite side thereof. That is, the teeth of gear according to this invention is distributed in the order of a shorter tooth, a transition tooth, a longer tooth, the other transition tooth, and another shorter teeth.

An external engaging gear pair according to the present invention comprises at least two gear-shaped rotors that engage with each other. The two rotors are provided with shorter teeth, transition teeth and at least one longer tooth on their pitch circles respectively. The shaft of the driving rotor and the shaft of the driven rotor are arranged to be parallel to each other. The center to center distance from the driving rotor to the driven rotor is equal to the radial sum of the pitch circles of the two rotors. The cross-section of the longer tooth is of a hawk beak shape, the profile of the longer tooth is composed of a convex section, a tip section, a concave section and a leading section of the longer tooth, which are smoothly connected one to another in series. The longer tooth is connected at its two sides to the shorter teeth via transition teeth.

At least one gear pair according to the present invention is formed as two gear-shaped rotors that engage with each other. One of the two rotors is an internal gear, and another is an external one, the two rotors are provided with shorter teeth, transition teeth and at least one longer tooth on their pitch circles respectively. The shaft of the driving rotor and the shaft of the driven rotor are arranged to be parallel to each other. The center to center distance from the driving rotor to the driven rotor is equal to the radial difference of the pitch circles of the two rotors. The cross-section of the longer tooth is of a hawk beak shape, the profile of the longer tooth is composed of a convex section of the longer tooth, a tip section of the longer tooth, a concave section of the longer tooth, and a leading section of the longer tooth. The four sections of the longer tooth are smoothly connected one to another in series, so as to form the profile of the longer tooth. The convex section of the longer tooth of the internal gear projects into the inside of the pitch circle of the internal gear, while the leading section thereof recesses into the outside of the pitch circle. The convex section of the external gear projects into the outside of the pitch circle of the external gear, while the leading section thereof recesses into the inside of the pitch circle. Two transition teeth are respectively provided at the two sides of the longer tooth between the longer tooth. Each transition tooth is in neighborhood relationship with the longer tooth on one side thereof and a shorter tooth on the other side thereof.

According to another aspect of the present invention, the external engaging gear-type compressor includes a casing which is composed of an "8"-shaped housing, an tipper end cover and a lower end cover. At least one pair of engaging gear-shaped rotors are accommodated in the casing, and each pair of engaging gear-shaped rotors include one driving rotor and one driven rotor. An gas inlet is provided on the casing, and at least one gas outlets are provided on the end covers. The driving rotor and driven rotor are provided with shorter teeth, transition teeth and at least one longer tooth on their pitch circles respectively. The cross-section of the longer tooth is of a hawk beak shape, and the profile of the longer tooth is composed of a convex section, a tip section, a concave section and a leading section. The four sections are smoothly joined together in a manner of one after another, so as to form the profile of the longer tooth. The two sides of longer tooth are both adjacently provided with a transition tooth which in turn adjoins a shorter tooth. An elementary volume is enclosed by the longer teeth of the rotors, the engaging point, the wall of the housing, the upper end cover, and the lower end cover. When the gear-type compressor operates, the elementary volume varies periodically. When the elementary volume increases, the elementary volume communicates with the gas inlet, while when the elementary volume reduces, the elementary volume communicates with the gas outlet, so as to accomplish a complete working process of a suction, a compression and an evacuation.

According to another aspect of the present invention, the internal engaging gear-type compressor includes a casing which comprises a cylinder, an upper end cover, and a lower end cover. A shims in a shape of a part of moon is accommodated in the casing. The shim occupies the superfluous portion of the rotating space of the driving and driven rotors. At least one pair of internal engaging gears which include one driving rotor and one driven rotor are provided within the casing. Gas inlet and gas outlet are provided on the end covers. The driving rotor and the driven rotor are provided with shorter teeth, transition teeth and at least one longer tooth on their pitch circles respectively. The cross-section of the longer tooth is of a hawk beak shape, and the profile of the longer tooth is composed of a convex section, a tip section, a concave section and a leading section. The four sections of the longer tooth are smoothly connected one after another, so as to form the profile of the longer tooth. The convex section of the external gear projects into the outside of the pitch circle of the external gear, while the leading section recesses into the inside of the pitch circle thereof. The convex section of the internal gear projects into the inside of the pitch circle of the internal gear, while the leading section thereof recesses into the outside of the pitch circle. The two sides of the longer tooth are both provided with a transition tooth which adjoins a shorter tooth in turn. An elementary volume is enclosed by the longer teeth of the two rotors, the engaging point, the upper and the lower end covers, and the shim. When the gear-type compressor operates, the elementary volume varies periodically. When the elementary volume increases, the elementary volume communicates with the gas inlet, while when the elementary volume reduces, the compression starts, then the elementary volume communicates with the gas outlet, so as to accomplish a complete working process of a suction, a compression and an evacuation.

ADVANTAGES OF THIS INVENTION

1. The two rotors keep engaging with each other, so that the driving force is directly transmitted from the driving rotor to the driven rotor while the working medium is perfectly sealed. In this way, the compressor can be simplified in structure, and the components of the compressor can be minimized.

2. The two rotors are both provided with the shorter teeth, the transition teeth and the longer teeth. Since the longer tooth is higher than the shorter tooth many times, the space between the rotors and the surrounding housing becomes larger, so that more effective area used for transferring fluid by the rotor of the gear pump can be used to transfer, compress or expand more working medium during one rotating working process of the rotors. As the effective area used for transferring fluid by the rotor of the gear pump is increased, the working efficiency of the gear pump is also improved.

3. For the external engaging gear-type compressor, when the tip sections of the longer teeth of the two rotors passes the edge of the gas inlet, an elementary volume is enclosed by the longer teeth of the two rotors, the engaging point, the wall of the "8"-shaped housing, and the upper and the lower end covers. In the compressor, the working medium is compressed so as to have a high-pressure. A clearance between the tip sections of the longer teeth of the two rotors and the housing is used to seal the working medium (the so-called slit seal solution). When the tip section of the longer tooth of the driving rotor reaches to the inflection point of the "8"-shaped housing, the tip section of the longer tooth of the driven rotor also reaches to the inflection point of the "8"-shaped housing. Once the tip sections of the longer teeth of the two rotors begin to disengage with the wall of the "8"-shaped housing, the tip section of the longer tooth of the driving rotor begins to engage with the starting point of the concave section of the longer tooth of the driven rotor. At this time, the tip section of the longer tooth of the driving rotor engages with the concave section of the longer tooth of the driven rotor, so that the working medium is kept being sealed. As no gap is appeared in the engaging point between the two rotors when the longer teeth of the two rotors disengage with the inflection point of the housing, the leakage of the working medium is prevented, so that the sealing effect can be kept during the complete working process. However, when the rotor with the traditional longer tooth profile is used, as the longer tooth of one gear engages with the longer tooth interval of the other gear, a gap is appeared between the high-pressure and low-pressure chambers when the longer teeth leave the inflection point of the "8"-shaped housing, resulting in a large amount of working medium backflow.

4. For the internal engaging gear-type compressor, when the tip section of the longer tooth of the driving rotor or the external gear passes the lower tip of the shim in the shape of a part of moon, an elementary volume is enclosed by the longer teeth of the two rotors, the engaging point of the two rotors, the shim in the shape of a part of moon, and the upper and the lower end covers. The working medium is sealed by means of the clearance provided between the longer teeth of the two rotors and the shim in the shape of a part of moon. Once the tip sections of the longer teeth of the driving and driven rotors reach to the upper tip of the shim in the shape of a part of moon, the tip sections of the longer teeth of the two rotors begin to disengage with the upper tip of the shim in the shape of a part of moon simultaneously. At the same time, the tip section of the longer teeth of the driving rotor is in engagement with the starting point of the leading section of the longer teeth of the driven rotor, so that an elementary volume is enclosed by the engaging point between the two rotors, the engaging point between the tip section of the longer tooth of the driving rotor and the concave section of the longer tooth of the driven rotor, and the upper and the lower end covers. In this way, no gap between the two longer teeth is appeared when the longer teeth of the two rotors pass through the upper tip of the shim in the shape of a part of moon, so that the perfect sealing effect is kept during the complete working process of a compression and an evacuation.

5. As the two rotors are in actual metallic engagement with each other, the fluid leakage between the two rotors can be minimum. In addition, as an oil injection technique is used, the fluid leakage through the clearance between the tip sections of the longer teeth and the housing and through other leakage passages can be greatly reduced, so that the volumetric efficiency is high and the compression ratio is also high.

6. All of the working medium in the closed elementary volume can be evacuated from the gas outlet, so no closed volume at the suction stage and/or closed volume at the discharge stage are remained in the compressor, so that the volumetric efficiency is improved.

7. When a rotor is provided with two or more longer teeth, since the longer teeth are symmetrically arranged with respect to the shaft of the rotor, the inertia force can be cancelled out completely. When the rotor is provided with only one longer tooth, the inertia force of the rotor can also be cancelled out completely by means of a balancing weight. As a result, the compressor can always be able to be kept a minimum vibration and noise.

8. In the prior art, the slip sheets, the spring and the valves as components of a compressor always subject to forces periodically varied, so they are liable to be damaged for fatigue reasons. In the present invention, however, no easily damaged components, such as the slip sheets, the spring and the valves, are arranged, so that the compressor seldom stop to work for the damage of the easily damaged components, thus the compressor according to the present invention is high in reliability.

9. Variant working conditions and variant capacity requirements can be conveniently met by means of regulating a slide valve, so as to help to save energy.

10. The rotor may be designed to have teeth which are perpendicular to the side surface of the rotor, so it is easier to manufacture the rotor.

DESCRIPTION OF THE DRAWINGS

The present invention will be further described together with the accompanying drawings, in which.

BEST EMBODIMENTS FOR CARRYING OUT THIS INVENTION

Figure 1:
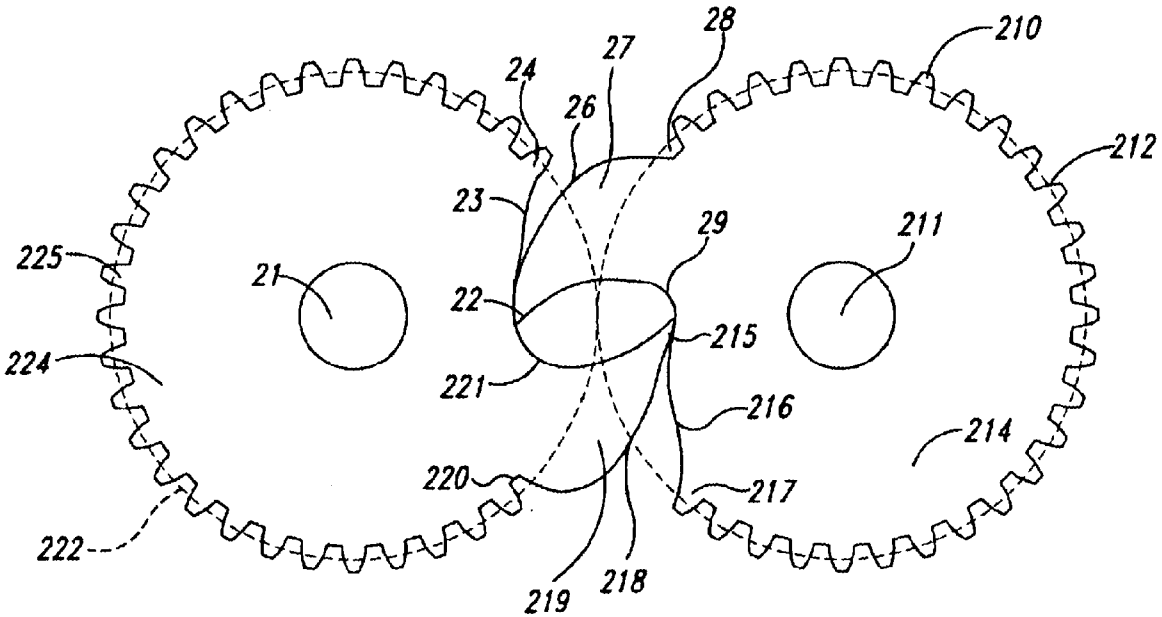
FIG. 1 is a schematic view showing the structure of rotors according to the present invention.

The rotors according to the present invention includes a driving rotor 214 and a driven rotor 224. The shaft 211 of the driving rotor 214 and the shaft 21 of the driven rotor 224 are arranged to be parallel to each other. The center to center distance from the driving rotor 214 to the driven rotor 224 is equal to the sum of the radii of the pitch circles 212 and 222 of the two rotors. The driving rotor 214 is formed with shorter teeth 210, convex transition teeth 217, concave transition teeth 28 and a longer tooth 27. The cross-sections of the longer teeth 27, 219 of the driving and driven rotors 214 and 224 respectively are of a hawk beak shape. The profile of the longer tooth 27 of the driving rotor 214 includes a convex section 26, a tip section 22, a concave section 29, and a leading section 216. The four sections 26, 22, 29, and 216 are smoothly connected in series, so as to form the profile of the longer tooth 27. Similarly, the profile of the longer tooth 219 of the driven rotor 224 is connected smoothly by a convex section 218, a tip section 215, a concave section 221 and a leading section 23 on after another. The convex sections 26 and 218 refer to the edge curves of the longer teeth from the pitch circle to the tip section. The tip sections 22 and 215 refer to a curve section at the top of the longer teeth connecting the convex section and the concave section. The tip section of an external gear is farthest from the center of the pitch circle thereof. The concave sections 29, 221 refer to such curves that extend from the tip sections 22, 215 to the root portions of the longer teeth and concave toward to the convex sections of the longer teeth. The leading sections 216, 23 refer to such curves that extend from the root portions to the pitch circles 212, 222 respectively. The transition teeth refer to the first short tooth connecting the longer tooth to the shorter teeth and there are two types of transition teeth i.e., the convex transition teeth 217, 24 and the concave transition teeth 28, 220. The convex section, the tip section, the concave section and the leading section can be connected smoothly by several sections of cycloids, lines, arcs, involutes and/or their envelope curves. The convex sections 26, 218 of the driving rotor 214 and the driven rotor 224 project into the outside of the pitch circle 212, 222. The two sides of the longer tooth 27 of the driving rotor 214 are respectively provided with the transition teeth 217, 28 which adjoins the shorter teeth 210 in turn. The two sides of the longer tooth 219 of the driven rotor 224 are respectively provided with the transition teeth 24, 220 which adjoins the shorter teeth 225 in turn. When the driving rotor 214 rotates in the clockwise direction, during the longer tooth 27 of the driving rotor engages with the longer tooth 219 of the driven rotor, until the engaging point is changing from the convex section 26 of longer tooth of the driving rotor 214 to the concave section 216 of the longer tooth of the driving rotor, the tip section 22 of the longer tooth of the driving rotor begins to be in disengagement condition, so that during this engaging-point changing process, a reasonable contact ratio (multiple engaging point solution) is used, thus a smooth and constant run of the rotors is realized. That is, the leading section should enter into engagement in time just before the convex section is out of engagement, or the convex section should enter into engagement in time just before the leading section is out of engagement. The transition teeth comprise convex transition teeth 217, 24 and concave transition teeth 28, 220. The convex transition tooth 217 of the driving rotor 214 is connected with the end point of the concave section 216 of the longer tooth. The concave transition tooth 28 is connected with the start point of the convex section 26 of the longer tooth. The convex transition tooth 24 of the driven rotor 224 is connected with the end point of the concave section 23 of the longer tooth. The concave transition tooth 220 is connected with the start point of the convex section 218 of the longer tooth. The convex transition tooth 217 of the driving rotor 214 and the concave transition tooth 220 of the driven rotor, having conjugate curves with respect to each other, can be in engagement with each other. The concave transition tooth 28 of the driving rotor and the convex transition tooth 24 of the driven rotor, with conjugate curves with respect to each other, can be in engagement with each other. The other shorter teeth are the conventional teeth as the prior art.

Figure 2:
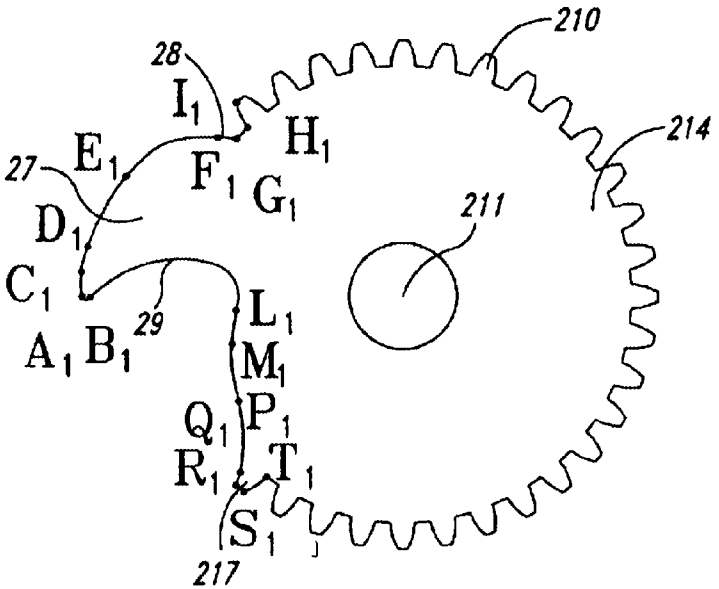
FIG. 2 is a schematic view showing one embodiment of the profile of the teeth of the driving rotor of the present invention.

In operation, the driving rotor 214 rotates in the clockwise direction, so as to make the driven rotor 224 to rotate in the anti-clockwise direction. In a case, the concave transition tooth 28 of the driving rotor 214 engages with the convex transition tooth 24 of the driven rotor 224. Then, the convex section 26 of the driving rotor 214 engages with the leading section 23 of the driven rotor 224. After that, the leading section 216 of the driving rotor 214 engages with the convex section 219 of the driven rotor 224. Then, the convex transition tooth 217 of the driving rotor 214 engages with the concave transition tooth 220 of the driven rotor 224. Then, the ordinary shorter teeth of the one rotor begin to engage with the ordinary shorter teeth of the another rotor. In this process, the perfect seal effect and therefore the effective driving is realized. On the other hand, if the driven rotor 224 rotates in the clockwise direction so as to drive the driving rotor 214 to rotate in the anti-clockwise direction, the perfect seal effect and therefore the effective driving can also be realized FIG. 2 shows one embodiment of the teeth profile of the driving rotor 214.

The convex section 26 of the driving rotor 214, i.e. the curve $A_1F_1$, is smoothly connected by a cycloid, a line, an arc and an envelope curve of lines, in which the section of $E_1F_1$ is the cycloid, $D_1E_1$ the line, $C_1D_1$ the arc, and $A_1C_1$ the envelope curve of the lines. The tip section 22, i.e. the curve $A_1B_1$, is a cubic spline curve or an arc. The concave section 29, i.e. the curve $B_1L_1$, is a cycloid which keeps engaging with a fixed point on the driving rotor or an envelope curve of arcs. The leading section 216, i.e. the curve $L_1Q_1$, is smoothly connected by three curves, in which the section of $L_1M_1$ is a line, $M_1P_1$ an envelope curve of lines, and $P_1Q_1$ a cycloid. On the profile of the concave transition tooth 28, the curve $F_1G_1$ is a cycloid, $G_1H_1$ a part of root circle and $H_1I_1$ an involute. On the profile of the protruding transition tooth 217, the curve $R_1Q_1$ is a cycloid, $R_1S_1$ a part of addendum circle and $S_1T_1$ an involute. The shorter teeth are ordinary involute teeth.

Figure 3:
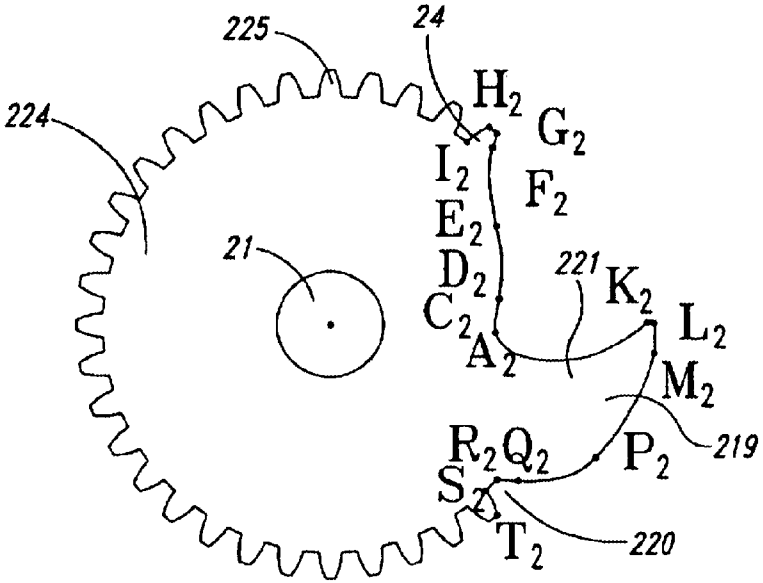
FIG. 3 is a schematic view showing one embodiment of the profile of the teeth of the driven rotor according to the present invention.
Figure 4:
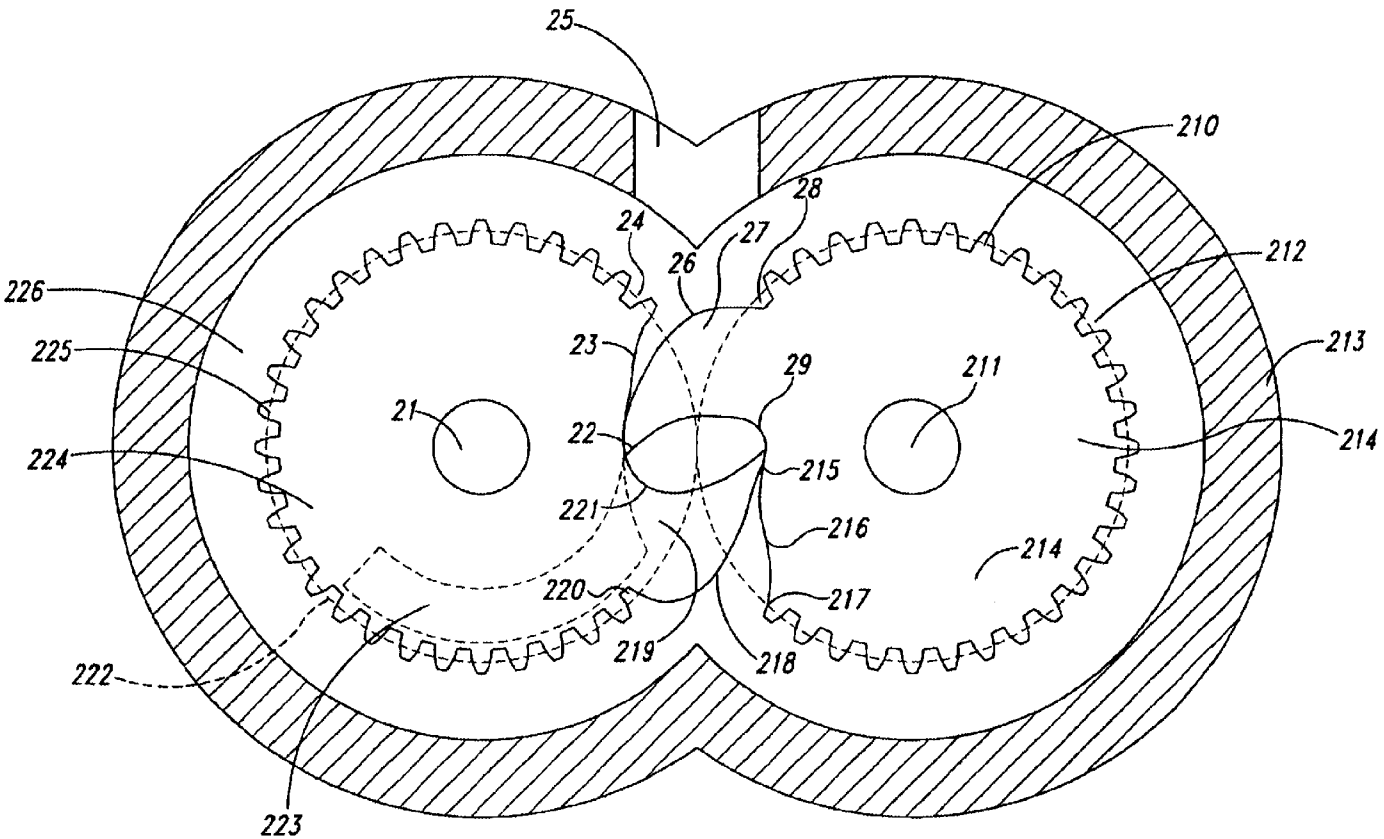
FIG. 4 is a schematic view showing the structure of the external engaging gear-type compressor according to the present invention.

FIG. 3 shows one embodiment of the teeth profile of the driven rotor 224.

The convex section 218 of the driven rotor 224, i.e. the curve $Q_2L_2$, is smoothly connected by a cycloid, a line, and an envelope curve of several lines, in which the section of $Q_2P_2$ is the cycloid, $P_2M_2$ the line, and $L_2M_2$ the envelope curve of the lines. The tip section 215, i.e. the curve $L_2K_2$, is a small section of arc. The concave section 221, i.e. the cure $A_2K_2$, is a cycloid which keeps engaging with a fixed point on the driving rotor or which is an envelope curve of arcs. The leading section 23, i.e. the curve $A_2F_2$, is smoothly connected by four sections, in which the section of $A_2C_2$ is a line, $C_2D_2$ an arc, $D_2E_2$ an envelope curve of the lines, and $E_2F_2$ a cycloid. Regarding to the profile of the concave transition tooth 220, the section of $R_2Q_2$ is a cycloid, $R_2S_2$ a part of the root circle, and $S_2T_2$ an involute. Regarding to the profile of the convex transition teeth 24, the section of $F_2G_2$ is a cycloid, $G_2H_2$ a part of the addendum circle, and $H_2I_2$ an involute. The shorter teeth are ordinary involute teeth.

In FIG. 2, the convex section 26 of the driving rotor 214, i.e. the section of $A_1F_1$, may have the following variant solution: the arc $C_1D_1$ is omitted and the line $D_1E_1$ is designed to be tangent both to the envelope curve $A_1C_1$ of several lines and to the cycloid $E_1F_1$, so as to form another type of the convex section which is composed of a cycloid, a line and an envelope curve of several lines in series. The cycloid $E_1F_1$ can also be replaced by an involute, in this case, the convex section is smoothly connected by an involute, a line, an arc, and an envelope curve of several lines in series. In addition, the cycloid $E_1F_1$ may also be replaced by a parabola, in this case, the convex section of the longer tooth is smoothly connected by a parabola, a line, an arc and an envelope curve of several lines in series. The cycloid $E_1F_1$ may also be replaced by a section of an ellipse, in this case, the convex section of the longer tooth is smoothly connected by a section of an ellipse, a line, an arc, and an envelope curve of several lines in series. Alternatively, the envelope curve $A_1C_1$ of several lines may be replaced by a cycloid, in this case, the convex section of the longer tooth is smoothly connected by a cycloid, a line, an arc, and a cycloid in series. The envelope curve $A_1C_1$ of several lines may also be replaced by a parabola, in this case, the convex section of the longer tooth is smoothly connected by a cycloid, a line, an arc, and a parabola in series. Alternatively, the envelope curve $A_1C_1$ of several lines may also be replaced with a section of an ellipse, in this case, the convex section of the longer tooth is smoothly connected by a cycloid, a line, an arc, and a section of an ellipse in series. In addition, the envelope curve $A_1C_1$ of several lines can be replaced with an arc and the arc $C_1D_1$ is omitted, then the convex section of the longer tooth is smoothly connected by a cycloid, a line, and an arc in series. In this way, several profile variants of the convex section can be obtained. Similarly, the profile of the convex section 218 of the driven rotor may be modified in the same way as done for the profile of the convex section 26 of the driving rotor.

The gearing zone of a pair of the internal engaging gears is arranged in the central area of the "8"-shaped housing, i.e., with an appearance of a pair of twin cylinders inter-invaded to each other. The two ends of the housing are provided with the upper end cover and the lower end cover respectively. The end covers or the side wall of the housing are provided with through holes for suction and discharge of gas (air) or liquid, so as to form a complete gear-type mechanism, it is realized to compress the gas, to expand the gas, to transfer the fluid or colloid by means of the chambers enclosed by the longer teeth of the rotors, the engaging points, and the side walls of the housing together with the through holes for suction and discharge of gas (air) or liquid.

A preferred embodiment of the compressor according to the present invention will be described together with the FIGS. 4 to 7.

The compressor according to the present invention is mainly composed of the gear-shaped rotors 214, 224 engaging with each other, the "8"-shaped housing 213, the upper and the lower end covers 43, 44. The shaft 211 of the driving rotor 214 and the shaft 21 of the driven rotor 224 are arranged to be parallel with each other. The axes of the two shafts are located in the centers of the two cylinders of the "8"-shaped housing respectively. The distance between the centers of the driving rotor 214 and the driven rotor 224 is equal to the sum of the radii of the two pitch circles 212 and 222 of the two rotors. The driving and driven rotors are provided with the shorter teeth 210, 225, the convex transition teeth 217, 24, the concave transition teeth 28, 220, and the longer teeth 27, 219 on their pitch circles 212, 222 respectively. The profiles of the longer teeth of the driving and driven rotors are formed by smoothly connecting the convex sections 26, 218, the tip sections 22, 215, the concave sections 29, 221, and the leading section 216, 23 respectively in series. The convex sections 26 and 218 refer to such curves that project from the pitch circles to the tip sections of the convex sections of the longer teeth respectively. The tip sections 22 and 215 refer to a curve section at the top of the longer teeth connecting the convex section and the concave section. The tip section of an external gear is farthest from the center of the pitch circle thereof. The concave sections 29, 221 refer to such curves that concave to the convex sections of the longer teeth and extend from the tip sections 22, 215 to the root portions of the longer teeth. The leading sections 216, 23 refer to such curves that extend from the root portions to the pitch circles 212, 222 respectively. The convex section, the tip section, the concave section, and the leading section are smoothly connected by several of the cycloids, the lines, the arcs, the involutes, and the envelope curves composed thereof. The convex sections 26, 218 project into the outside of the pitch circles 212, 222. The two sides of the longer teeth 27, 219 of the driving and driven rotors are provided with the convex transition teeth 217, 24 and the concave transition teeth 28, 220 respectively, and the transition teeth further adjoin the shorter teeth 210, 225, respectively. The upper and the lower end covers are in the shape of a plate, and they are arranged on the two ends of the housing 213 respectively. The gas discharge ports, i.e. gas (air) outlets 223, which are in a shape of a section of a ring, are provided on the one or two end covers of the driven rotor 224. In detail, the radius of the outer arc 42 of the air outlet is slightly shorter than the radius of the root circle of the shorter teeth of the driven rotor, while the radius of the inner arc 41 of the air outlet is larger than or equal to the minimum distance from the concave section of the longer tooth of the driven rotor to the axis thereof. The starting position of the air outlet 223 is set by a pre-determined pressure. The ending position of the air outlet is an arc whose center is the axis of the driving rotor and whose radius is the distance from the axis to the tip section of the longer tooth of the driving rotor. The air inlet 25 is located on the side wall of the housing. The axis of the air inlet 25 is on an imaging line connecting the two inflection points 410, 411 of the two cylinders of the "8"-shaped housing 213. The driving rotor 214 rotates in the clockwise direction. When the tip section of the longer tooth of the driving rotor 214 rotates into the area of the air inlet 25, the working chamber 226 enclosed by the walls of the housing and the upper and the lower end covers is divided into two closed elementary volumes by means of the longer teeth 27, 219 of the two rotors and the engaging points of the two rotors. One of the elementary volume becomes bigger and bigger and communicates with the air inlet 25, so as to run in the suction process, while the other the elementary volume becomes smaller and smaller, then communicates with the air outlet 223, so as to run in the compression and gas discharge process. As the driving rotor 214 rotates, each of the elementary volumes finishes a complete working process, that is, the processes of suction, compression and evacuation. When one elementary volume finishes a complete working process, that is, the processes of suction, compression and evacuation, the rotor needs to rotate an angle of $4\pi$. Whenever the rotor rotates an angle of $2\pi$, there is one process of suction and evacuation. In operation, no closed suction volume and closed evacuation volume are formed, and efficient suction is kept.

Figure 5:
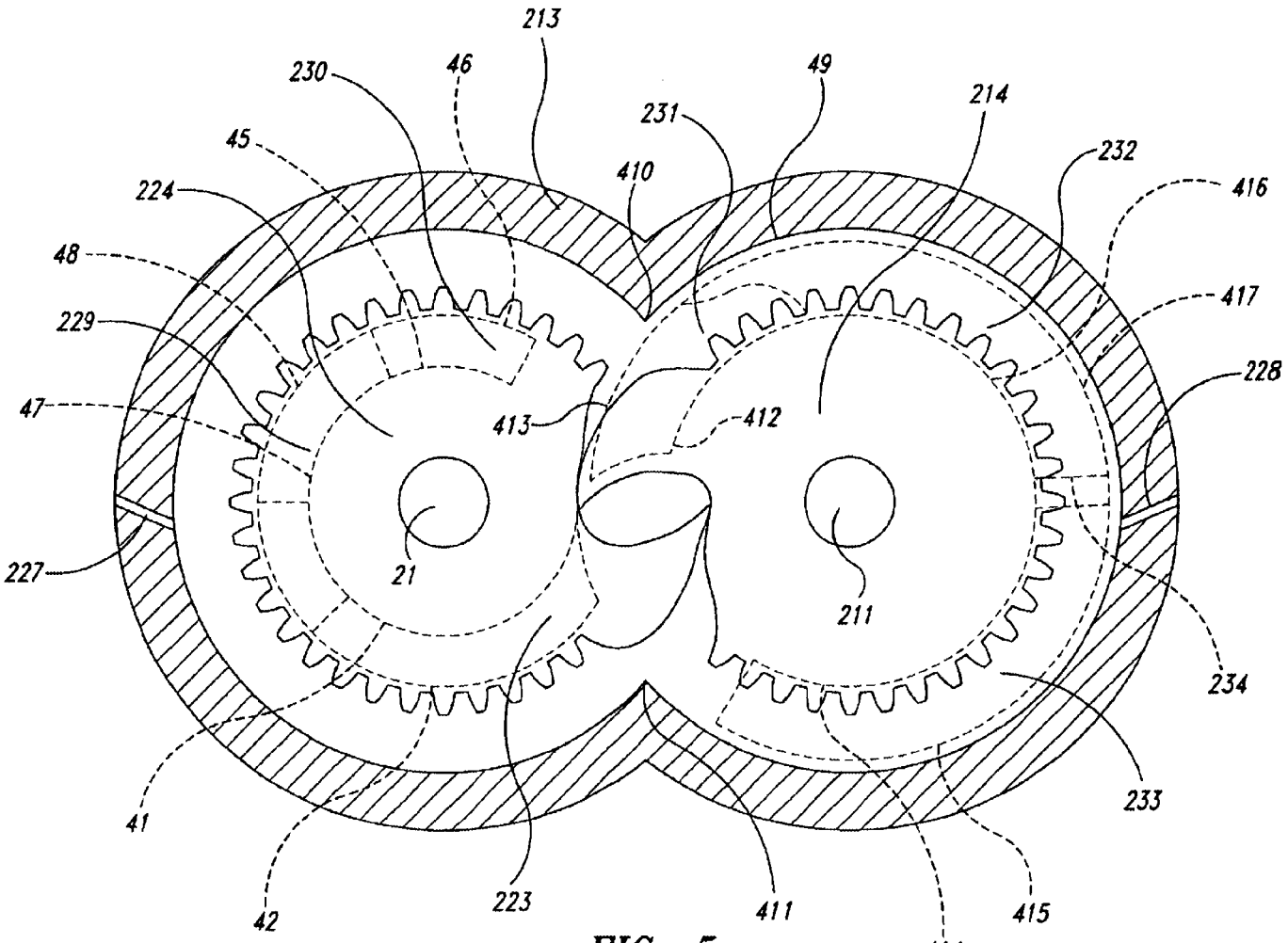
FIG. 5 is a schematic view of the whole structure of one embodiment of the present invention, in which the upper end cover is provided with a slide valve regulating means and liquid spraying apertures.

FIG. 5 is a schematic view of the whole structure of the gear-type compressor, in which the air inlet and air outlet of the upper end cover are provided with a sliding valve regulating means and the housing is provided with a liquid spraying aperture.

Figure 6:
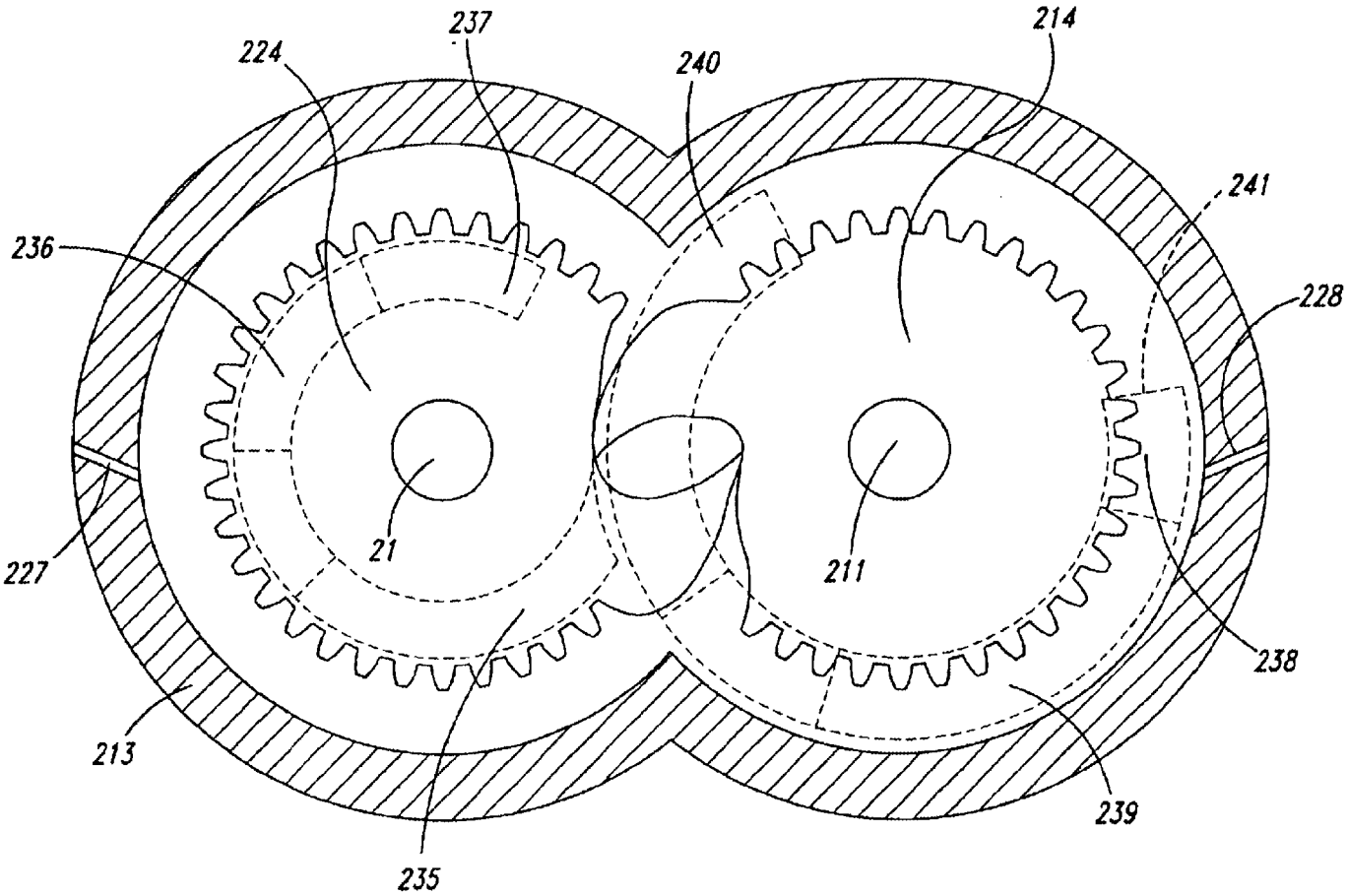
FIG. 6 is a schematic view of the whole structure of one embodiment of the present invention, in which the lower end cover is provided with a slide valve regulating means and liquid spraying apertures.

FIG. 6 is a schematic view of the whole structure of the gear-type compressor, in which the lower end cover is provided with an air inlet, an air outlet and a sliding valve regulating means, and the housing is provided with a liquid spraying aperture.

Since a gear-type compressor is a complete built-in compression machine, once the air inlet 231 has been designed, the evacuation pressure is determined only by the starting and ending positions of the air outlet 223. When the evacuation pressure needs to be changed according to the working condition, the sliding valve 229 can be operated so as to regulate the starting and ending positions of the air outlet, and therefore regulate the final pressure of the built-in compression, so that the over compression can be avoided and energy consumption can be reduced. The gear-type compressor can be widely used under different working conditions and can always save energy. A concave sliding valve groove 230 in a shape of a section of a ring is provided on the upper end cover of the gear-type compressor, being near the inner surface of the housing. One end of the sliding valve groove 230 is communicated with the air outlet 223. The radii of the inner arc 45 and the outer arc 46 of the sliding valve groove 230 are equal to the radii of the inner arc and the outer arc of the air outlet 223 respectively. The sliding valve groove 230 is provided with a sliding valve 229 in a shape of a section of a ring. The radii of the inner arc 47 and the outer arc 48 of the sliding valve 229 are equal to the radii of the inner arc and the outer arc of the air outlet 223 respectively. If a two-side discharge method is adopted, the area for gas discharging can be doubled, while the loss for gas discharging resistance can be reduced. In this case, the sliding valves can be provided on the two end covers, so as to be suitable to variant working conditions. The concave sliding valve grooves 230, 237 in a shape of a section of a ring are respectively provided on the upper and the lower end covers, being near to the inner surface of the housing. One end of the sliding valve grooves 230, 237 are communicated with the air outlet 223, 235, respectively. The radii of the inner arc and the outer arc of the sliding valve groove 230, 237 are equal to the radii of the inner arc and the outer arc of the air outlet 223, 235 respectively. The sliding valve grooves 230, 237 are respectively provided with the sliding valves 229, 236 in a shape of a section of a ring. The radii of the inner arc and the outer arc of the sliding valve 229, 236 are equal to the radii of the inner arc and the outer arc of the air outlet 223, 235 respectively. When the discharge pressure needs to be increased, the sliding valves 229, 236 can be rotated in the anti-clockwise direction along the sliding valve grooves 230, 237, so that the area of the air outlets 223, 235 becomes smaller and smaller, thus the final pressure of the built-in compression is enhanced. On the other hand, if the sliding valves 229, 236 are rotated in the clockwise direction, the final pressure of the built-in compression will be reduced. The air inlet, i.e. the gas absorbing port, can be arranged in various solutions. According to one of the solutions, the air inlet 25 is arranged on the side wall of the housing 213. In this solution, the axis of the air inlet 25 is located to coincide an imaging line between the two inflection points of the "8"-shaped housing 213. In many cases, the gas transferring amount is required to be able to be regulated, that is, variable volume regulation is required. Especially, the capability of variable volume regulation is very important for the compressor of the air-conditioner for the automobiles. By setting sliding valve in the air inlet, the gear-type compressor can conveniently realize the variable volume regulation, nearly no power loss, and even can realize a stepless regulation. In this case, the air inlet 231 is provided on an end cover which is the so called upper end cover. The radius of the radially inner arc 412 of the air inlet 231 is equal to or slightly smaller than the root circle of the shorter teeth of the driving rotor. The radius of the radially outer arc 413 of the air inlet 231 is slightly smaller than that of the inner radius 49 of one end of the cylinder on the side of the driving rotor 214. A concave sliding valve groove 233 in a shape of a section of a ring is provided on the upper end cover, being near the inner surface of the housing. One end of the sliding valve groove 233 is communicated with the air inlet 231. The radii of the inner arc 414 and outer arc 415 of the sliding valve groove 233 are equal to the radii of the inner arc and outer arc of the air inlet 231 respectively. A sliding valve 232 in a shape of a section of a ring is provided on the sliding valve groove. The radii of the inner arc 416 and outer arc 417 of the sliding valve 232 are equal to the radii of the inner arc and outer arc of the air inlet 231 respectively. When the gas transferring volume needs to be reduced, the sliding valve 232 of the air inlet can be rotated in the clockwise direction, so as to make the area of the air inlet 231 becomes bigger and bigger, thus the elementary volume of compression and evacuation, which is formed when the tip sections of the two longer teeth 27, 219 passes the inflection point of the "8"-shaped housing, is still communicated with the air inlet 231. As a result, the working medium, which has entered into the elementary volume of compression and evacuation, partially backflows from air inlet 231, so that the working medium compressed in one working cycle is reduced, thus the variable volume regulation can be realized. If the upper and the lower end covers are both provided with sliding valves regulating means, the range of volume regulation will be wider. In an embodiment, the regulating means of the upper end cover is not changed, while an air inlet 238 in a shape of a section of a ring and a sliding valve groove 240 in a shape of a section of a ring are provided on the lower end cover. The radii of the inner arc and outer arc of the air inlet 238 are equal to the radii of the inner arc and outer arc of the air inlet in the upper end cover. The starting position 241 of the air inlet of the lower end cover is slightly located before the ending position 234 of the air inlet of the upper end cover. The sliding valve groove 240 is provided with a sliding valve 239 in a shape of a section of a ring. The gas transferring volume can be further regulated by regulating the location of the sliding valve 239. The sliding valves in the upper and the lower end covers cab be cooperated with each other, so that the gear-type compressor can have a wide range of volume regulation, so as to be able to be used in different conditions.

Figure 7:
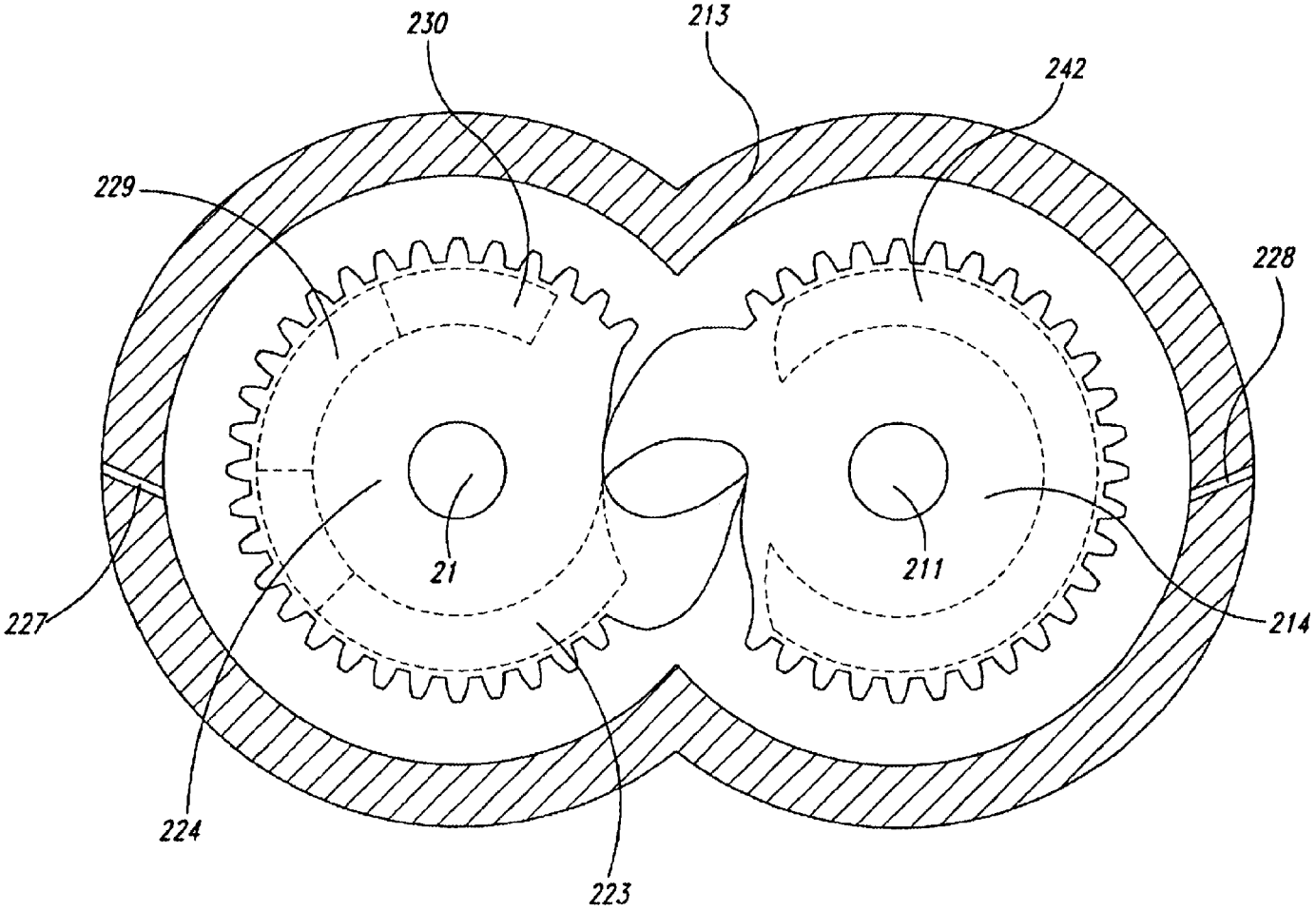
FIG. 7 is a schematic view of the whole structure of one embodiment of the present invention, in which the end cover is provided with an gas inlet.

FIG. 7 shows an air inlet arrangement solution. An air inlet 242 in a shape of a section of a ring is provided on one end cover. The air inlet is provided on the end cover on the side of the driving rotor 214. The radius of the inner arc of the air inlet is slightly shorter than the radius of the root circle of the shorter teeth of the driving rotor 214. The radius of the inner arc of the air inlet is equal to the minimum distance from the leading section of the longer tooth of the driving rotor to the axis of the driving rotor. In the gear-type compressor, clearances are provided between the side surfaces and the end covers and between the tip sections of the longer teeth and the inner surface of the housing, as a result, the fluid leakage through the clearances cannot be prevented. As shown in FIG. 5, liquid spraying apertures 227, 228 are provided on the side wall of the housing. By means of using the liquid spraying technique, the fluid leakage, through the clearances can be greatly reduced, while generated noise is also reduced and a good lubrication effect is obtained. As the liquid spraying reduces the temperature in the compressor and the power loss of the compressor, the single-stage compression ratio can be greatly improved.

Figure 8:
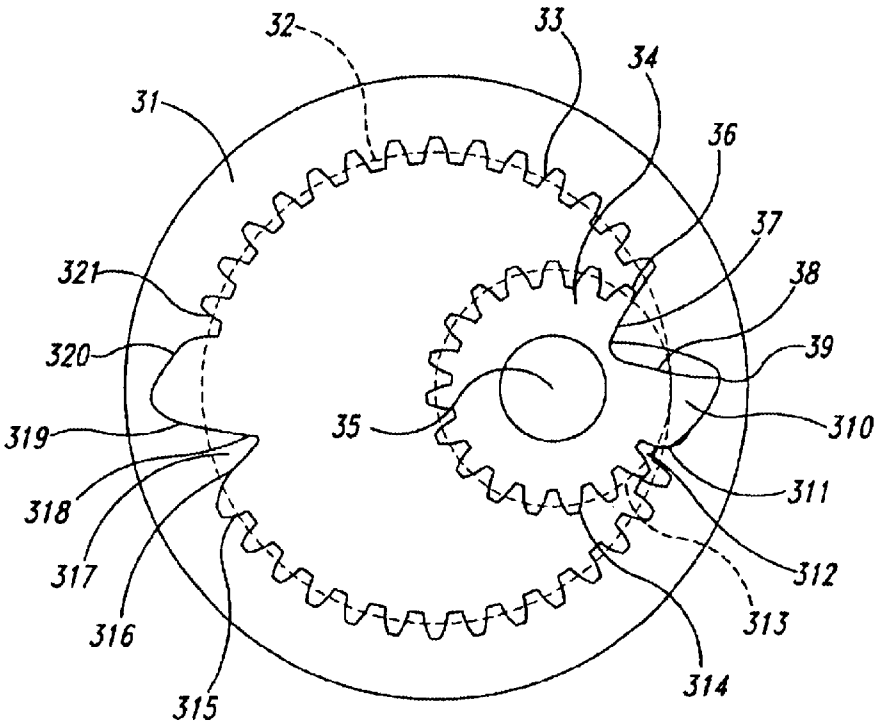
FIG. 8 is a schematic view showing one embodiment of the structure of the rotors of the internal gear pair according to the present invention.

FIG. 8 is a schematic view showing the structure of the rotors which are a pair of inner gearing gears according to the present invention. According to another embodiment of the present invention, the fluid machine includes an internal gear 31 and an external gear 34. The internal gear 31 works as the driven rotor, while the external gear 34 works as the driving rotor. The shaft 35 of the driving rotor 34 and the shaft the driven rotor are arranged to be parallel with each other. The distance between the axes of the driving rotor 34 and the driven rotor 31 is equal to the radius difference of the pitch circles 32, 313 of the two rotors. The driving rotor 34 is provided with shorter teeth 314, a convex transition teeth 36, a concave transition teeth 312 and a longer tooth 310. The cross-section of the longer tooth 310 of the driving rotor 34 is of a hawk beak shape, and the profile thereof is smoothly connected by a convex section 311, a tip section 39, a concave section 38, and a leading section 37 in series. The convex sections 311 refers to such a convex curve that extends from the pitch circle 313 of the longer tooth 310 to the tip section thereof. The concave section 38 refers to such a concave curve that extends from the tip section 39 to the root portion of the longer tooth. The tip section 39 refers to a curve section at the top of the longer tooth connecting the convex section and the concave section. The tip section of an external gear is farthest from the center of the pitch circle thereof. The leading section 37 refers to such a curve that extends from the root portion of the longer tooth to the pitch circles 313 thereof. The transition teeth refer to the first short tooth connecting the longer tooth to the shorter teeth, and there are two types of transition teeth, i.e., the convex transition tooth 36 and the concave transition tooth 312. The convex section 311 of the external gear, i.e. the driving rotor 34, projects into the outside of the pitch circle 313. The two sides of the longer tooth 310 are respectively provided with the convex transition tooth 36 and the concave transition tooth 312. The convex transition tooth 36 and the concave transition tooth 312 adjoin the shorter teeth 314 in turn. The driven rotor, i.e. the internal gear 31, is provided with shorter teeth 33, a convex transition teeth 321, a concave transition teeth 315, and a longer tooth 317. The cross-section of the longer tooth 317 of the internal gear 31 is of a hawk beak shape, and the profile of the longer tooth 317 is smoothly connected by a convex section 316, a tip section 318, a concave section 319, and a leading section 320 in series. The convex sections 316 of the internal gear 31 refers to such a convex curve that extends from the pitch circle of the longer tooth 310 to the tip section 318 thereof. The concave section 319 refers to such a concave curve that extends from the tip section 318 to the root portion of the longer tooth. The tip section 318 refers to a curve section at the top of the longer tooth connecting the convex section and the concave section. The tip section of an internal gear is nearest from the center of the pitch circle thereof. The leading sections 320 refers to such a curve that extends from the root portion of the longer tooth to the pitch circle 32. The transition teeth refer to the first short tooth connecting the longer tooth to the shorter teeth, and there are two types of transition teeth, i.e., the convex transition tooth 321 and the concave transition tooth 315. The convex section 316 of the internal gear 31 projects into the inside of the pitch circle 32, while the leading section 320 recesses into the outside of the pitch circle 32. The two sides of the longer tooth 317 are respectively provided with the convex transition tooth 321 and the concave transition tooth 315. The convex transition tooth 321 and the concave transition tooth 315 adjoin the shorter teeth 33 in turn. The convex section, the tip section, the concave section, and the leading section are all smoothly connected by several sections of cycloids, lines, arcs, involutes and envelope curves thereof.

The convex section 311 of the longer tooth 310 of the external gear 34 and the leading sections 320 of the longer tooth 317 of the external gear 31, as conjugate curves, engages with each other. The leading sections 37 of the longer tooth 310 of the external gear 34 and the convex section 316 of the longer tooth 317 of the external gear 31, as conjugate curves, engages with each other. The profiles of the two sides of the transition teeth are different. The shorter teeth are ordinary teeth of the conventional gear.

When the driving rotor 34 rotates in the clockwise direction, the longer tooth 310 of the driving rotor engages with the longer tooth 317 of the driven rotor 31. In the case that the engagement point reaches the leading section 37 of the longer tooth of the driving rotor 34, the engagement line is broken at the tip section 39 of the longer tooth of the driving rotor 34. During such operation, the reasonable contact ratio can make the gears transmit power or driving force smoothly and constantly. That is, the leading section must enter into engagement in time just before the convex section is out of engagement, or the convex section must enter into engagement in time just before the leading section is out of engagement. Then, the convex transition tooth 36 of the driving rotor 34 engages with the concave transition tooth 315 of the driven motor. The shorter teeth engage with each other so as to form a perfect sealing effect and transmit power or driving force.

During rotors rotates in engagement with each other, a seal effect is realized along the engaging lines between a shorter tooth of one rotor and a transition tooth of the other rotor. When the rotors rotates, it is more important that a seal effect for the working medium in the working chamber is also realized between the longer tooth 317 of the internal gear 31 and the longer tooth 310 of the internal gear 34 with benefits of the shape of a hawk beak. Especially, it can be realized for such a pair of rotors to compress, expand and transfer the fluids.

Figure 9:
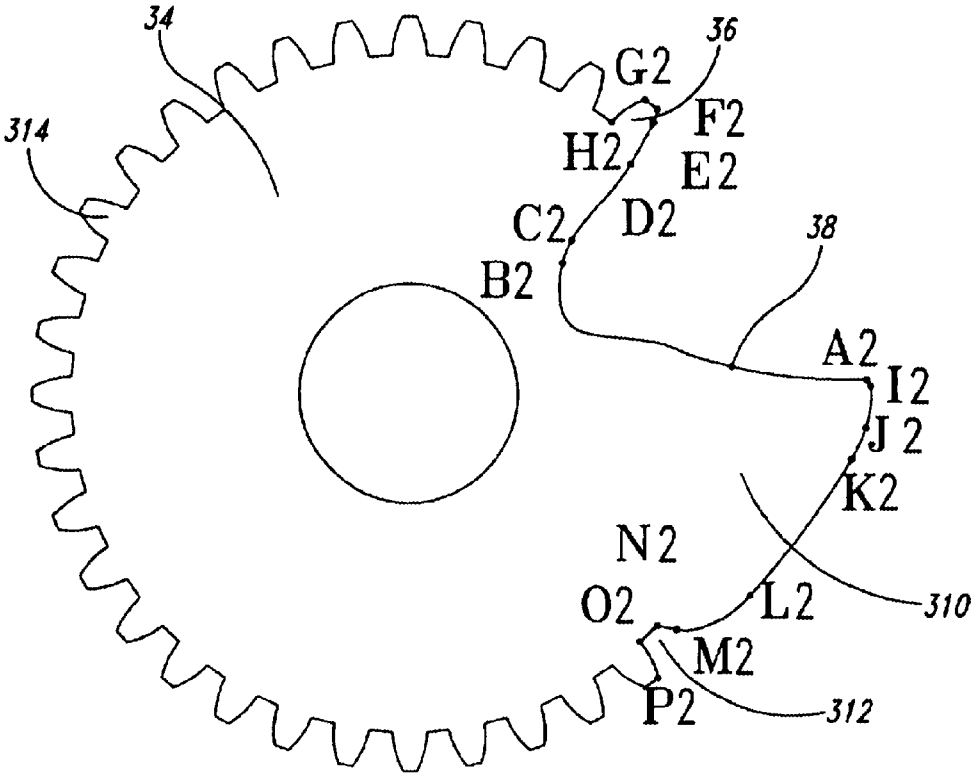
FIG. 9 is a schematic view showing one embodiment of the profile of the external gear according to the present invention.

FIG. 9 shows one embodiment of the profile of the teeth of the external gear.

The convex section 311 of the longer tooth 310 of the driven rotor 34, i.e. the curve $I_2M_2$, is smoothly connected by a cycloid, a line, an arc, and an envelope curve of several lines, in which the section of $M_2L_2$ is the cycloid, $L_2K_2$ the line, $K_2J_2$ the arc, and $I_2J_2$ the envelope curve of the lines. The tip section 39, i.e. the curve $A_2I_2$, is an arc. The concave section 38, ie. the curve $B_2A_2$, is a curve composed of a cycloid and arcs, the cycloid being such one that keeps engaging with a fixed point on the driving rotor. The leading section 37, i.e. the curve $B_2E_2$, is in series connected by a line, an arc, and an envelope curve of another several lines, in which the section of $B_2C_2$ is the line, $C_2D_2$ the arc, and $D_2E_2$ is the envelope curve of the another several lines. Regarding to the profile of the convex transition teeth 36, the section of $E_2F_2$ is a cycloid, $F_2G_2$ a part of addendum circle, and $H_2G_2$ an involute. On the concave transition tooth 312, the section of $M_2N_2$ is a cycloid, $O_2N_2$ a part of root circle, and $O_2P_2$ an involute. The shorter teeth are ordinary involute teeth.

Figure 10:
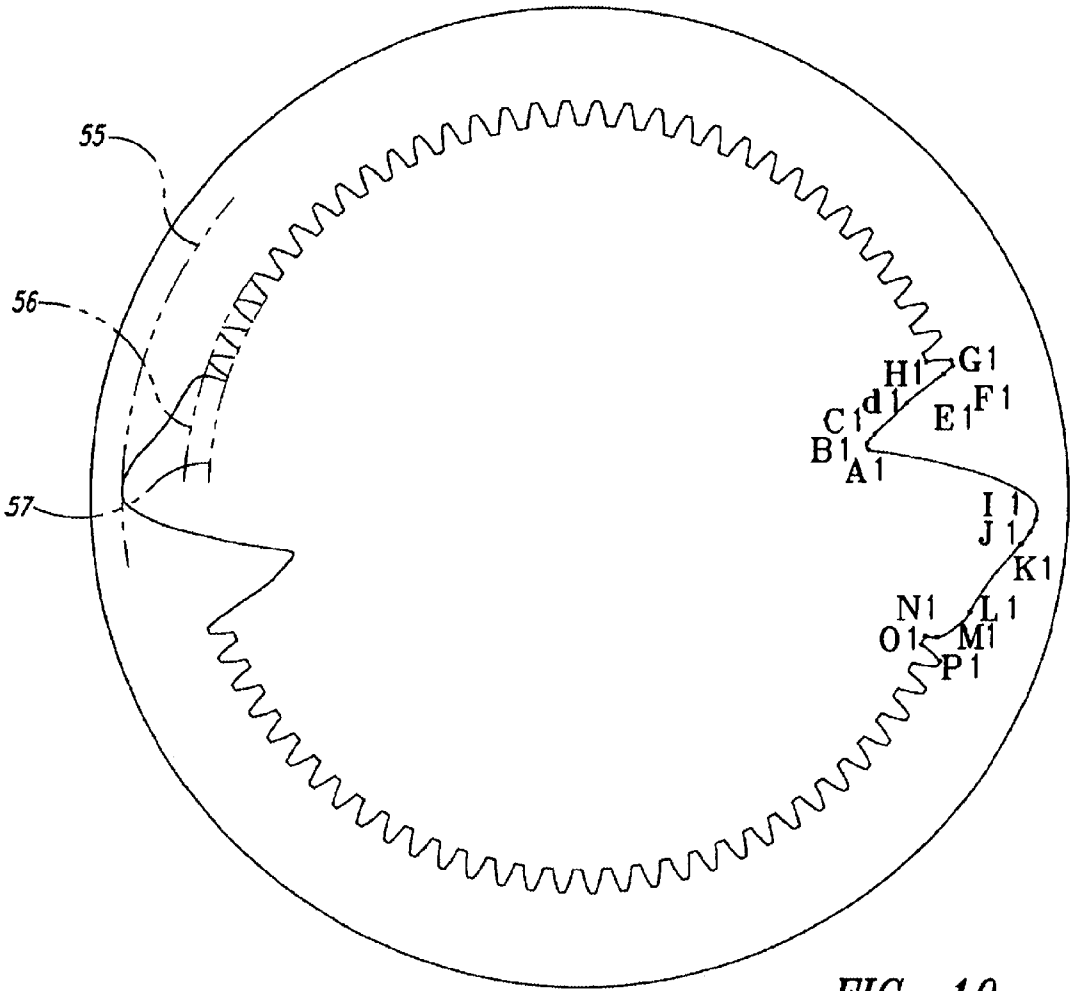
FIG. 10 is a schematic view showing one embodiment of the profile of the internal gear according to the present invention.

FIG. 10 shows one embodiment of the profile of the teeth of the internal gear 31. The convex section 316 of the longer tooth 317 of the internal gear 31, i.e. the curve $B_1E_1$, is smoothly connected in series by a line, an arc, and an envelope curve of another several lines, in which the section of $B_1C_1$ is the envelope curve of several lines, $C_1D_1$ the arc, $D_1E_1$ the envelope curve of another several lines. The tip section 318 of the longer tooth 317, i.e. the curve $A_1B_1$, is the arc. The concave section 319, i.e. the curve $A_1I_1$, is a point-engaging forming cycloid. The leading section 320, i.e. the curve $I_1M_1$, is smoothly connected in series by a line, an arc, an envelope curve of another several lines, and a cycloid, in which the section of $I_1J_1$ is the line, $J_1K_1$ the arc, $K_1L_1$ is the envelope curve of the lines, and $L_1M_1$ the cycloid. Regarding to the profile of the convex transition tooth 321, the section of $M_1N_1$ is a cycloid, $O_1N_1$, a part of addendum circle, and $O_1P_1$ an involute. On the concave transition tooth 315, the section of $E_1F_1$ is a cycloid, $F_1G_1$, an arc, a part of root circle, and $H_1G_1$ an involute. The shorter teeth are ordinary involute teeth.

The pair of the internal engaging gears are arranged within a cylindrical body. A shim in the shape of a part of moon is provided in the space for the two rotors' rotation. The upper end cover 51 and the lower end cover 52 are respectively installed at the two ends of the cylinder. The end covers are provided with through holes for fluid suction and evacuation. In this way, a complete internal engaging gear-type fluid machine is formed, so as to compress, expand, and convey the fluids.

Figure 11:
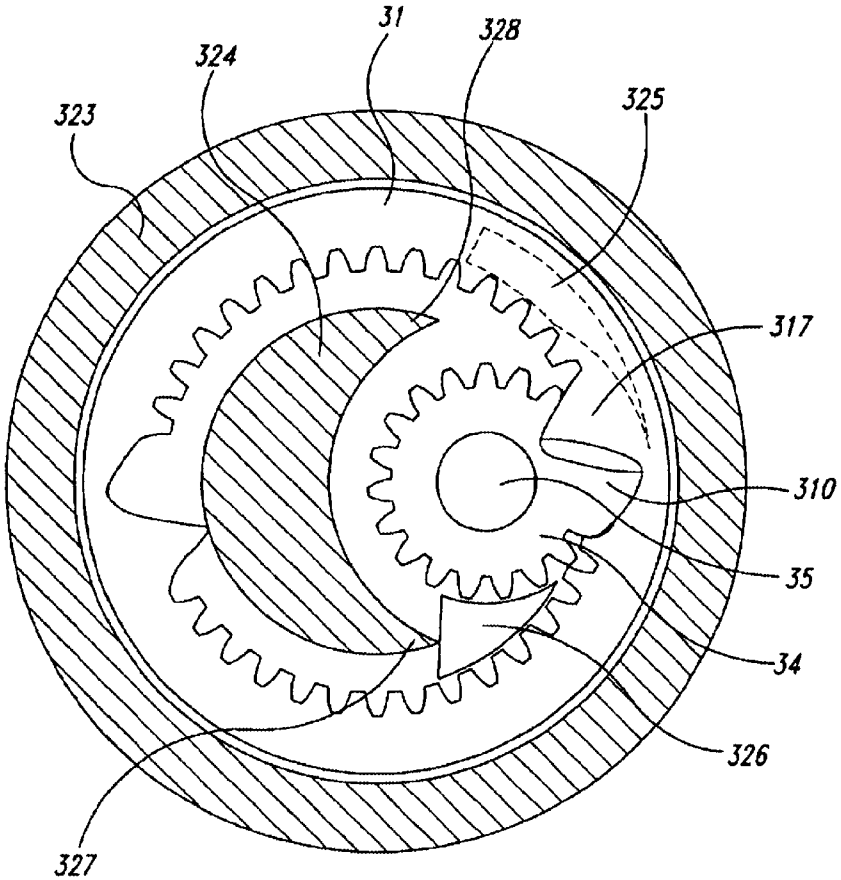
FIG. 11 is a schematic view showing one embodiment of the whole structure of the internal engaging gear-type gas compressor according to the present invention.

FIG. 11 is a schematic view of one embodiment of the internal engaging gear-type compressor. The shim 324 in the shape of a part of moon, the external gear 34, and the internal gear 31 are all arranged within the cylindrical body 323. An air inlet 326 is defined by the addendum circle 57 of the shorter teeth of the internal gear, the addendum circle of the shorter teeth of the external gear, and a line passing through the lower tip section 327 of the shim. An air outlet 325 is arranged on the end cover, and located between the root circle 56 of the shorter teeth 33 of the internal gear 31 and the root circle 55 of the longer tooth 317. That is, the radius of the inner arc 53 of the air outlet is equal to or larger than the radius of the root circle of the shorter teeth of the driven rotor, and the radius of the outer arc 54 of the air outlet is equal to or smaller than the radius of the root circle of the longer tooth of the driven rotor. An elementary volume is enclosed by the longer teeth 317, 310 of the two rotors, the shim 324 in the shape of a part of moon, and the engaging point of the two rotors. When the longer tooth 310 of the external gear 34 rotates so as to reach to the lower tip section 327 of the shim 324 in the shape of a part of moon, the closed elementary volume is formed, so that the gas can be compressed. When the longer teeth 317, 310 of the longer teeth of the two rotors rotates so as to reach to the upper tip section 328 of the shim 324 in the shape of a part of moon, the two longer teeth and the upper tip section 328 of the shim 324 begin to be in their engagement with one another simultaneously, thus a perfect seal effect is realized in the upper tip section 328 of the shim 324. When the leading section of the longer tooth of the internal gear 31 rotates to pass the air outlet 325, the gas begin to discharge from the elementary volume. In this way, a complete working cycle, i.e., suction, compression and evacuation, is realized.

By means of sliding valves provided on the gas discharging port (air outlet) and the gas absorbing port (air inlet), the variable working conditions and the variable gas transferring volume can be conveniently regulated.

Figure 12:
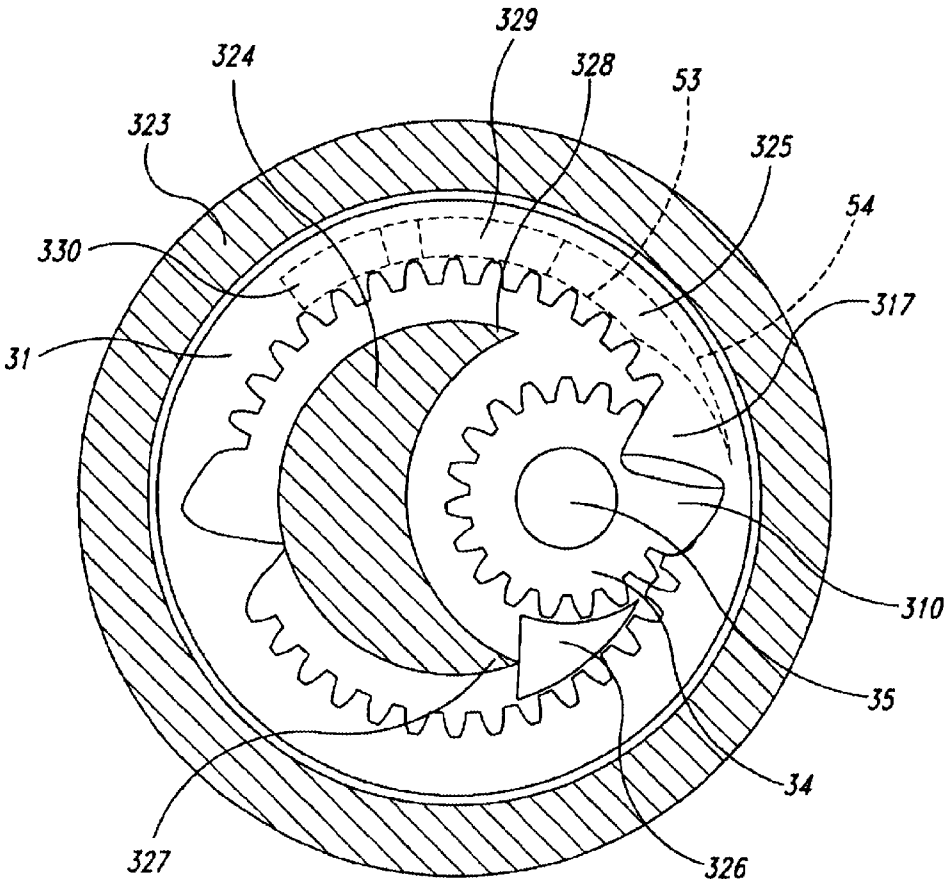
FIG. 12 is a schematic view showing another embodiment of the whole structure of the internal engaging gear-type gas compressor according to the present invention.
Figure 13:
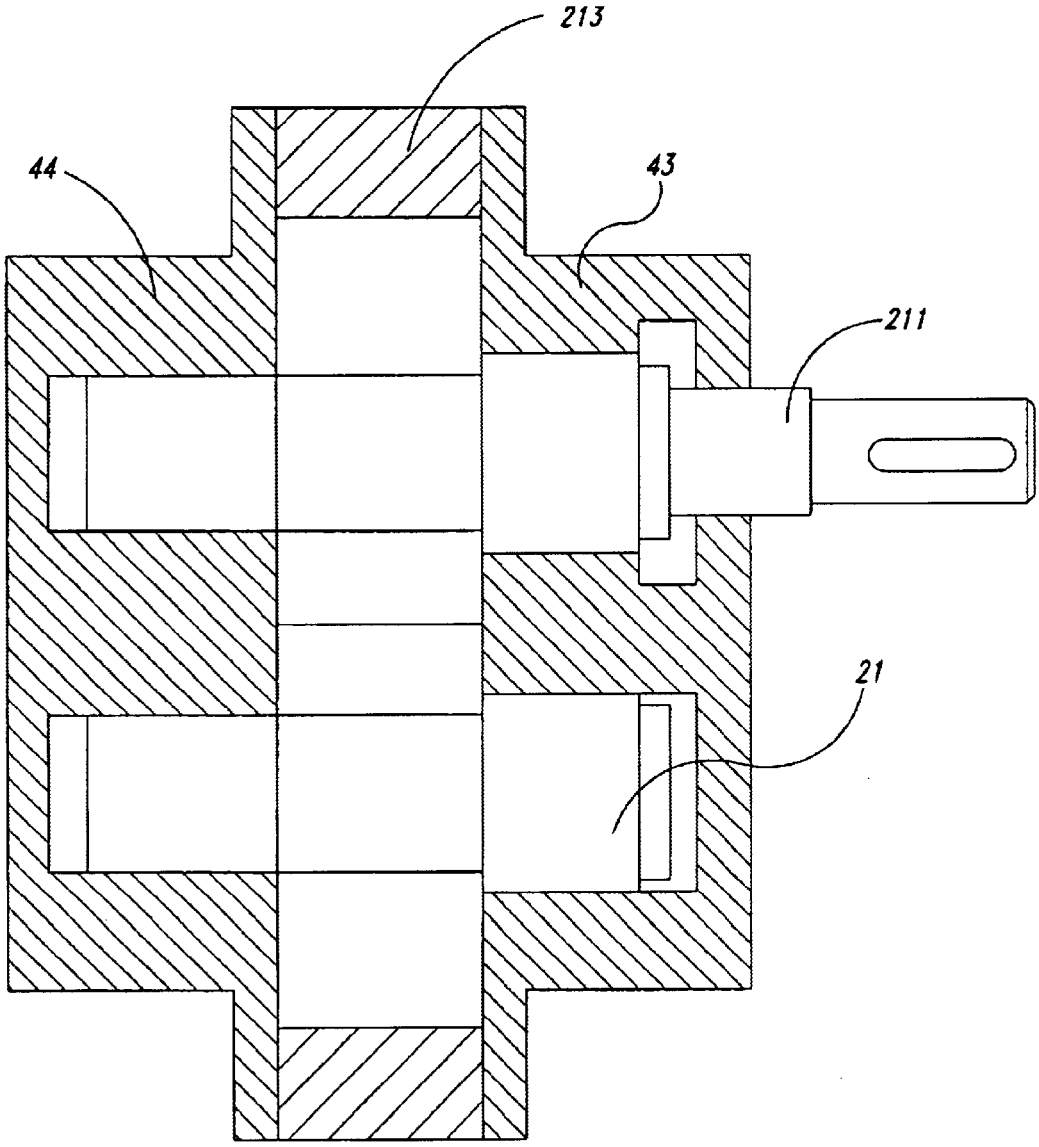
FIG. 13 is a schematic view of a portion of one embodiment of the present invention illustrating the upper and lower end covers.
Figure 14:
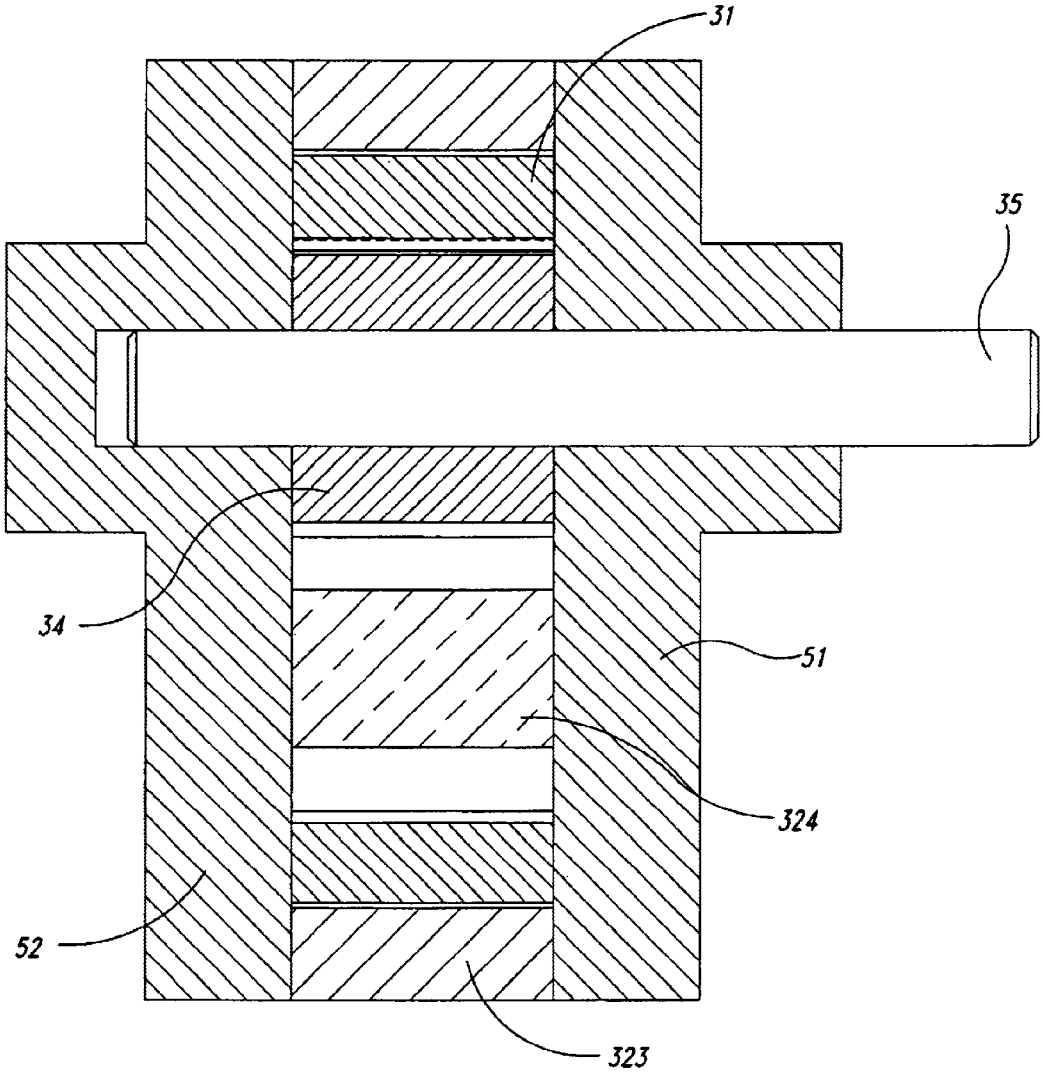
FIG. 14 is a schematic view of a portion of another embodiment of the present invention illustrating the upper and lower end covers.

FIG. 12 is a schematic view of the internal engaging gear-type compressor, in which sliding valves are provided. By moving the sliding valve 329 along the sliding valve groove 330, the air outlet 325 may be opened to be wider or narrower, so that a stepless regulation is realized, so as to be suitable to variable working conditions.

The fluid machine according to this invention can also be used as an expansion machine.

This invention is directed to use minimum components to solve the problems on the seal effect and the transmission reliability of rotary fluid machines, so as to effectively compress, expand, and transfer the fluids.

According to this invention, among every curve sections of the longer tooth in the shape of a hawk beak, the convex section and the leading section is used to transmit power and to seal the fluids, while the tip section and the concave section is used to seal the fluids within a desired working chamber.

The preferred embodiments of the present invention have been described in detail together with the accompanying drawings. However, the present invention is not limited to the preferred embodiments. Those skilled in the art will appreciate that various modifications, substitutions and improvements are possible without departing from the scope and spirit of the invention.

For example, the gear according to this invention may be provided with only one longer tooth, but it can also be provided with two or more longer teeth.

Especially, the longer teeth can be even distributed along the circumferential direction.

Moreover, according to this invention, more than two gears with at least one longer tooth can be arranged in the expansion machine or the compressor. The radii of such gears can be same as or different to each other.

Although the teeth of the above embodiments are all spur teeth, they can be made as helical or herringbone teeth.

Moreover, the gear according to this invention not only can be a columnar gear, but also can be a bevel gear.

Furthermore, the gear according to this invention not only can be a circular gear, but also can be a non-circular gear.

As stated above, the gear according to this invention not only can be an external gear, but also can be an internal gear.

Moreover, in the fluid machine according to this invention, a pair of engaging gears can be both the external gears, but they can also be one external gear and one internal gear.

By means of regulating the rotating speed of rotors, such as by using different frequencies, the fluid machine according to this invention can also have variable gas transfer volumes.

In addition, in the fluid machine according to this invention, a clearance can be arranged between the engaging points of a pair of engaging gears, so the machine can be used in such industrial fields that its products such as the food and the textile cannot be contaminated by the lubricating oil. In the case, this pair of engaging gears is driven by other separate synchronizing gears.

INDUSTRIAL APPLICABILITY OF THIS INVENTION

This invention can be applied into a wide range of the industrial fields such as the compressor, the pump, the fluid measurement, the hydraulic motor, and the compact machines.

What is claimed is:

1. A gear comprising shorter teeth, transition teeth and at least one longer tooth on its pitch circle, wherein the cross-section of said longer tooth is of a hawk beak shape, the profile of said longer tooth is smoothly connected in series by a convex section, a tip section, a concave section, and a leading section, the two sides of said longer tooth are respectively provided with a transition tooth, and each of the transition teeth neighbors a shorter tooth on the opposite side of said longer tooth, characterized in that said convex section and leading section of said longer tooth are designed with a reasonable contact ratio so that the leading section can enter into engagement in time just before the convex section is out of engagement, or the convex section can enter into engagement in time just before the leading section is out of engagement.

2. The gear as defined in the claim 1, wherein the profile of the convex section of said longer tooth is smoothly connected in series by a cycloid, a line and an envelope curve of another several lines.

3. The gear as defined in the claim 1, wherein the profile of the convex section of said longer tooth is smoothly connected in series by a cycloid, a line, an arc, and an envelope curve of another several lines.

4. The gear as defined in the claim 1, wherein the profile of the convex section of said longer tooth is smoothly connected in series by an involute, a line, an arc, and an envelope curve of another several lines.

5. The gear as defined in the claim 1, wherein the profile of the convex section of said longer tooth is smoothly connected in series by a parabola, a line, an arc, and an envelope curve of another several lines.

6. The gear as defined in the claim 1, wherein the profile of the convex section of said longer tooth is smoothly connected in series by a section of an ellipse, a line, an arc, and an envelope curve of another several lines.

7. The gear as defined in the claim 1, wherein the profile of the convex section of said longer tooth is smoothly connected in series by a cycloid, a line, an arc, and another cycloid.

8. The gear as defined in the claim 1, wherein the profile of the convex section of said longer tooth is smoothly connected in series by a cycloid, a line, an arc, and a parabola.

9. The gear as defined in the claim 1, wherein the profile of the convex section of said longer tooth is smoothly connected in series by a cycloid, a line, an arc, and a section of an ellipse.

10. The gear as defined in the claim 1, wherein the profile of the tip section of the longer tooth of said driving rotor is an arc or a cubic spline curve.

11. The gear as defined in the claim 1, wherein the profile of the concave section of the longer tooth of said driven rotor is an envelope curve of different arcs or a cycloid keeping engaging with a fixed point on the driving rotor.

12. The gear as defined in the claim 1, wherein the profile of the tip section of the longer tooth of said driven rotor is an arc.

13. The gear as defined in the claim 1, wherein the leading section of the longer tooth of the driven rotor engages with the convex section of the longer tooth of the driving rotor.

14. The gear as defined in the claim 1, wherein the leading section of the longer tooth of the driving rotor engages with the convex section of the longer tooth of the driven rotor.

15. The gear as defined in the claim 1, wherein the tip section of the longer tooth of the driving rotor engages with the concave section of the longer tooth of the driven rotor.

16. The gear as defined in claim 1, wherein the profile of the transition tooth is smoothly connected in series by a cycloid, an arc and involutes.

17. The gear as defined in claim 1, wherein said shorter teeth are formed with involutes.

18. A fluid machine for transferring, compressing or expanding the fluids, including a casing comprising a "8"-shaped housing, an upper end cover and a lower end cover, in which at least one pair of engaging gear-shaped rotors working as one driving rotor and one driven rotor are accommodated in said casing, at least one gas absorbing port or air inlet is provided on said casing, at least one gas discharging port or air outlet is provided on said end covers, said driving rotor and driven rotor are provided with shorter teeth, transition teeth and at least one longer tooth on their pitch circles respectively, wherein the cross-section of said longer tooth is of a hawk beak shape, the profile of said longer tooth is smoothly connected in series by a convex section, a tip section, a concave section, and a leading section, the convex section of the longer tooth projects into the outside of the pitch circle, the two sides of said longer tooth are respectively provided with a transition tooth which adjoins a shorter tooth on the opposite side of said longer tooth, characterized in that said convex section and leading section of said longer tooth are designed with a reasonable contact ratio so that the leading section can enter into engagement in time just before the convex section is out of engagement, or the convex section can enter into engagement in time just before the leading section is out of engagement.

19. The fluid machine as defined in the claim 18, wherein said end covers are in shape of a plate, one of the end covers is provided with an gas outlet in a shape of a section of ring, the gas outlet is located at the side where the driven rotor is provided, the radius of the outer arc of the air outlet is slightly shorter than the radius of the root circle of the shorter teeth of the driven rotor, and the radius of the inner arc of the air outlet is equal to the minimum distance from the leading section of the longer tooth of the driven rotor to the axis of the shaft of the driven rotor.

20. The fluid machine as defined in the claim 18, wherein said upper and lower end covers being in shape of a plate are provided with air outlets in a shape of a section of ring, the air outlets are located at the side where the driven rotor is provided, the radius of the outer arc of the air outlets is slightly shorter than the radius of the root circle of the shorter teeth of the driven rotor, and the radius of the inner arc of the air outlets is equal to the minimum distance from the leading section of the longer tooth of the driven rotor to the axis of the shaft of the driven rotor.

21. The fluid machine as defined in the claim 18, wherein, at a position of closing to the inner surface of the casing, said end covers are provided with at least one concave sliding valve groove in a shape of a section of a ring, one end of the sliding valve groove is communicated with the air outlet, the radii of the inner arc and outer arc of the sliding valve groove are equal to the radii of the inner arc and outer arc of the air outlet respectively, a sliding valve in a shape of a section of a ring is provided on the sliding valve groove, and the radii of the inner arc and outer arc of the sliding valve are equal to the radii of the inner arc and outer arc of the air outlet respectively.

22. The fluid machine as defined in the claim 18, wherein said end covers are in shape of a plate, one of the end covers is provided with an air inlet in a shape of a section of a ring, the air inlet is located at the side where the driving rotor is provided, the radius of the outer arc of the air inlet is slightly shorter than the inner radius of the cylinder, and the radius of the inner arc of the air inlet is equal to the root circle of the shorter teeth of the driving rotor.

23. The fluid machine as defined in the claim 18, wherein said upper end cover is provided with an air inlet, the radius of the outer arc of the air inlet is slightly shorter than the inner radius of the cylinder on the side of the driving rotor, the radius of the inner arc of the air inlet is equal to the root circle of the shorter teeth of the driving rotor, at a position of closing the inner surface of the casing, the upper end cover is provided with a concave sliding valve groove in a shape of a section of a ring, one end of the sliding valve groove is communicated with the air inlet, the radii of the inner arc and outer arc of the sliding valve groove are equal to the radii of the inner arc and outer arc of the air inlet respectively, a sliding valve in a shape of a section of a ring is provided on the sliding valve groove, and the radii of the inner arc and outer arc of the sliding valve are equal to the radii of the inner arc and outer arc of the air inlet respectively.

24. The fluid machine as defined in the claim 18, wherein said upper and lower end cover are provided with air inlets, the radius of the outer arc of the air inlet of the upper end cover is slightly shorter than the inner radius of the cylinder at the side of the driving rotor, the radius of the inner arc of the air inlet is equal to the root circle of the shorter teeth of the driving rotor, at a position of closing the inner surface of the casing, the upper end cover is provided with a concave sliding valve groove in a shape of a section of a ring, one end of the sliding valve groove is communicated with the air inlet, the radii of the inner arc and outer arc of the sliding valve groove are equal to the radii of the inner arc and outer arc of the air inlet respectively, a sliding valve in a shape of a section of a ring is provided on the sliding valve groove, the radii of the inner arc and outer arc of the sliding valve are equal to the radii of the inner arc and outer arc of the air inlet respectively, at a position of closing the inner surface of the casing, the lower end cover is also provided with an air inlet and a concave sliding valve groove both of which are in a shape of a section of a ring, the radii of the inner arc and outer arc of the air inlet of the lower end cover are equal to the radii of the inner arc and outer arc of the air inlet of the upper end cover respectively, the radii of the inner arc and outer arc of the sliding valve groove are equal to the radii of the inner arc and outer arc of the air inlet respectively, the starting position of the air inlet of the lower end cover is slightly located before the ending position of the air inlet of the upper end cover, and a sliding valve in a shape of a section of a ring is provided to bridge on the sliding valve groove.

25. The fluid machine as defined in the claim 18, wherein said end covers are provided with air inlets in a shape of a section of a ring, the air inlets are located at the side where the driving rotor is provided, the radius of the outer arc of the air inlet is slightly shorter than the root circle of the shorter teeth of the driving rotor, and the radius of the inner arc of the air inlet is equal to the minimum distance from the leading section of the longer tooth of the driving rotor to the axis of the shaft of the driving rotor.

26. The fluid machine as defined in the claim 18, wherein said side wall of the "8"-shaped housing is provided with an air inlet, the axis of the air inlet is arranged to coincide with the imaging line passing through the inflection points of the two cylinders of the "8"-shaped housing.

27. The fluid machine according to claim 18, wherein said fluid machine is a gear-type fluid conveyer.

28. The fluid machine according to claim 18, wherein said fluid machine is a gear-type compressor.

29. The fluid machine according to claim 18, wherein said fluid machine is a gear-type expansion machine.

30. A fluid machine for transferring, compressing or expanding the fluids, including a shim in the shape of a part of moon and a casing comprising a cylinder body, an upper end cover and a lower end cover, in which at least one pair of internal engaging gears is accommodated in said casing, working as one driving rotor and one driven rotor respectively, said end covers are provided with through holes for suction and evacuation of gas or liquid, and said driving rotor and driven rotor are provided with shorter teeth, transition teeth and at least one longer tooth on their pitch circles respectively, characterized in that the cross-section of said longer tooth is of a hawk beak shape, the profile of said longer tooth is smoothly connected in series by a convex section, a tip section, a concave section, and a leading section, the convex section of the longer tooth of the external gear projects into the outside of the pitch circle, the convex section of the longer tooth of the internal gear projects into the inside of the pitch circle, and the two sides of said longer tooth are respectively provided with a transition tooth which neighbors a shorter tooth on the opposite side of said longer tooth.

31. The fluid machine as defined in the claim 30, wherein said end covers are in shape of a plate, one or two end covers are provided with air outlets in a shape of a section of a ring, the air outlets are located at the side where the driven rotor is provided, the radius of the inner arc of the air outlets is longer than or equal to that of the root circle of the shorter teeth of the driven rotor, and the radius of the outer arc of the air outlets are shorter than or equal to that the root circle of the longer tooth of the driven rotor.

32. The fluid machine as defined in the claim 30, wherein said end covers are in shape of a plate, one of the end covers is provided with an air inlet, the air inlet is defined by the addendum circle of the shorter teeth of the driving rotor, the addendum circle of the shorter teeth of the driven rotor and a line passing through the tip section of the shim in a shape of a part of moon.

33. The fluid machine according to claim 30, wherein said fluid machine is a gear-type fluid conveyer.

34. The fluid machine according to claim 30, wherein said fluid machine is a gear-type compressor.

35. The fluid machine according to claim 30, wherein said fluid machine is a gear-type expansion machine.

36. The fluid machine according to claim 30, wherein said end covers are provided with at least one sliding valve groove in which a sliding valve in a shape of a half ring is provided.

* * * * *